US007357819B2

(12) United States Patent
Killick et al.

(10) Patent No.: US 7,357,819 B2
(45) Date of Patent: Apr. 15, 2008

(54) FUEL BLENDS

(75) Inventors: Robert William Killick, Mount Waverley (AU); Andrew Robert Killick, Richmond (AU); Peter William Jones, Menzies Creek (AU); Peter Ronald Wrigley, Blackburn (AU); John David Morrison, Thomastown (AU)

(73) Assignee: Victorian Chemicals International Pty Ltd, Richmond (AU)

( * ) Notice: Subject to any disclaimer, the term of this patent is extended or adjusted under 35 U.S.C. 154(b) by 611 days.

(21) Appl. No.: 10/476,556

(22) PCT Filed: May 7, 2002

(86) PCT No.: PCT/AU02/00563

§ 371 (c)(1),
(2), (4) Date: Apr. 6, 2004

(87) PCT Pub. No.: WO02/090469

PCT Pub. Date: Nov. 14, 2002

(65) Prior Publication Data

US 2004/0154219 A1 Aug. 12, 2004

(30) Foreign Application Priority Data

May 7, 2001 (AU) ..... PR4802
May 7, 2001 (AU) ..... PR4804

(51) Int. Cl.
*C10L 1/18* (2006.01)
*C10L 1/22* (2006.01)

(52) U.S. Cl. ..... 44/451; 44/385; 44/388; 44/418; 44/443

(58) Field of Classification Search ..... 44/302, 44/388, 443, 418, 451, 385
See application file for complete search history.

(56) References Cited

U.S. PATENT DOCUMENTS

| | | | | |
|---|---|---|---|---|
| 3,651,633 | A * | 3/1972 | Steinmiller | 57/247 |
| 4,297,107 | A * | 10/1981 | Boehmke | 44/301 |
| 5,578,090 | A * | 11/1996 | Bradin | 44/308 |
| 5,720,784 | A * | 2/1998 | Killick et al. | 44/451 |
| 6,017,369 | A | 1/2000 | Ahmed | |
| 6,511,520 | B1 * | 1/2003 | Eber et al. | 44/388 |
| 7,014,668 | B2 * | 3/2006 | Golubkov et al. | 44/438 |

FOREIGN PATENT DOCUMENTS

| | | |
|---|---|---|
| WO | WO 95/02654 A | 1/1995 |
| WO | WO 98/17745 A | 4/1998 |
| WO | WO 98/56878 A1 | 12/1998 |
| WO | WO 00/31216 A1 | 6/2000 |
| WO | WO 01/18155 A1 | 3/2001 |

OTHER PUBLICATIONS www.dieselnet.com/standards/us/fuel.html 1997-2007.*

* cited by examiner

*Primary Examiner*—Cephia D. Toomer
(74) *Attorney, Agent, or Firm*—Drinker, Biddle & Reath LLP.

(57) ABSTRACT

There is provided a diesel fuel blend comprising one or more commercially available diesel fuels; ethanol and a coupling agent.

17 Claims, No Drawings

FUEL BLENDS

FIELD OF THE INVENTION

The invention relates to fuel blend compositions including diesel fuel and alcohol.

BACKGROUND OF THE INVENTION

In this specification, where a document, act or item of knowledge is referred to or discussed, this reference or discussion is not to be taken as an admission that the document, act or item of knowledge or any combination thereof was at the priority date:

(a) part of common general knowledge; or (b) known to be relevant to an attempt to solve any problem with which this specification is concerned.

Diesel oil, due to its cost and availability, continues to be the backbone for industry around the world being the principal fuel for use in truck, ships, trains, some cars and other automotive equipment and different stationary types of engines.

It is recognised that the combustion of diesel fuel in engines can be hazardous to the environment. In particular, the partial combustion of diesel fuel to carbon-based particulates, hydrocarbons and carbon monoxide creates noxious black exhaust gases while the additional problem of nitrogen oxide production adds to the pollution. This is particularly observable in trucks and other automotive vehicles where noxious black exhaust gases can be seen as they are released from the vehicle exhaust into the environment.

Attempts have been made over the years to address the environmental concerns associated with exhaust fumes from engines by using alcohols such as methanol or ethanol as fuels. Such attempts, for instance, have established that 15% ethanol and 85% diesel oil provides a fuel of acceptable burning capacity without the necessity of modifying existing diesel engines.

The problem with using ethanol or methanol as a fuel in conjunction with diesel oil is that ethanol and methanol are immiscible with diesel oil within the normal range of operating temperatures, that is, they cannot be uniformly mixed or blended into one phase without rapid separation into their component parts.

One attempt to address the immiscibility problem involved mixing diesel fuel, a C3 (excluding n-propanol)-C22 organic alcohol and either (i) ethanol and/or n-propanol or (ii) a mixture of two or more of methanol, ethanol and n-propanol. Another attempt tried mixing diesel fuel, up to 20% ethanol or n-propanol and up to 15% of a fatty acid and/or organic ester.

However the presence of a significant water content may cause separation of the alcohol and diesel fuel. Water can enter into the fuel in a number of ways. These include (i) absorbing water from the air, (ii) the alcohol often having some intrinsic water content, and (iii) diesel fuel picking up water from the refinery pipes which are usually flushed with water.

Water also forms a constant boiling azeotrope with ethanol. Further attempts to remove the water fail by distillation. Even if substantially dehydrated ethanol is prepared, it is very hygroscopic and will quickly absorb moisture from the atmosphere unless subjected to special storage techniques.

One attempt to address the water content problem involved the use of a surfactant system comprising N, N-dimethylamine and a long chain fatty acid substance in a hybrid fuel microemulsion containing diesel fuel, water and alcohol. These trials further concluded that the advantage provided by N,N-dimethylamine could not be extrapolated to all amine compounds because in a comparative trial 2-amino-2-methyl-1-propanol was substituted for N,N-dimethylamine and the substituted formulations were not water tolerant to the same low temperatures.

A second attempt involved using an ethoxylated fatty alcohol and/or its reaction product with an amide as a stabilising additive. A third attempt involves using a polymeric fuel additive formed by reacting together an ethoxylated alcohol and a fatty alkanolamide.

There is therefore a need for fuel blends which are more water tolerant, especially at lower temperatures.

SUMMARY OF THE INVENTION

It has been found that diesel fuel and ethanol blends may be prepared which are more water tolerant.

According to a first aspect of the invention there is provided a diesel fuel blend comprising:

(a) greater than about 65% of one or more diesel fuels;

(b) up to about 20% v/v of ethanol; and (c) up to about 15% v/v of a coupling agent comprising:

(i) greater than about 60% w/w 2-ethylhexanol (also called iso-octanol);

(ii) from 10 to 40% w/w of one or more fatty alkanolamides; and (iii) up to about 10% w/w of one or more fatty acids.

The diesel fuel suitable for use in this invention is any essentially petroleum-based fuel which is suitable for use in a diesel engine.

The sources of ethanol to be used in the invention may range from commercially available rectified spirit which typically has 5% water through to absolute ethanol. More preferably, the ethanol will be super dry having less then 0.2% water.

Those skilled in the art will be aware of suitable fatty alkanolamides which may be used. The fatty alkanolamide may be derived from primary or secondary alkanolamines. Examples of suitable alkanolamines include ethanolamine, diethanolamine, diglycolamine, isopropanolamine and diisopropanolamine. The fatty acid portion is preferably selected from the C8 to C20 saturated or unsaturated fatty acids and may be derived from natural vegetable origins (e.g. coconut, canola, soybean), animal origins (e.g. tallow or lard) or synthetic origins. Preferably, the fatty alkanolamide is oleyl diethanolamide or coconut diethanolamide.

Those skilled in the art will be aware of suitable fatty acids which may be used. The fatty acid is preferably selected from the C8 to C20 saturated or unsaturated fatty acids and may be derived from natural vegetable origins (e.g. coconut, canola, soybean), animal origins (e.g. tallow or lard) or synthetic origins. Preferably the fatty acid is commercially available oleic acid or low rosin tall oil.

According to a second aspect of the invention, there is provided a coupling agent for use in fuel blends comprising diesel fuel and ethanol, the coupling agent comprising:

(i) greater than about 60% w/w 2-ethylhexanol (also called iso-octanol);

(ii) from 10 to 40% w/w of one or more fatty alkanolamides; and (iii) up to about 10% w/w of one or more fatty acids.

It has further been found that alternative diesel fuel and ethanol blends may be prepared which are more water tolerant.

According to a third aspect of the invention there is provided a diesel fuel blend comprising:

(a) greater than about 65% v/v of one or more diesel fuels;

(b) up to about 20% v/v of ethanol; and (c) up to about 15% of a coupling agent comprising:

(i) greater than about 60% w/w of one or more alkyl esters of fatty acids;

(ii) from 10 to 40% w/w of one or more fatty alkanolamides; and (iii) up to about 10% w/w of one or more fatty acids.

Those skilled in the art will be aware of suitable alkyl esters of fatty acids which may be used. The fatty acid portion is preferably selected from the C8 to C20 saturated or unsaturated fatty acids and may be derived from natural vegetable origins (e.g. coconut, canola, soybean), animal origins (e.g. tallow or lard) or synthetic origins. The alkyl esters may be derived from C1 to C8 alcohols. Preferably, the alkyl ester of fatty acids is methyl soyate or methyl canolate.

According to a fourth aspect of the invention, there is provided a coupling agent for use in fuel blends comprising diesel fuel and ethanol, the coupling agent comprising:

(i) greater than about 60%/% w/w of one or more alkyl esters of fatty acids;

(ii) from 10 to 40% w/w of one or more fatty alkanolamides; and (iii) up to about 10% w/w of one or more fatty acids.

Further it has been found that the two alternative formulations may be combined to provide alternative diesel fuel and ethanol blends may be prepared which are more water tolerant.

According to a fifth aspect of the invention there is provided a diesel fuel blend comprising:

(a) greater than about 65% v/v of one or more diesel fuels;

(b) up to about 20% v/v of ethanol; and (c) up to about 15% of a coupling agent comprising:

(i) greater than about 60% w/w of one or more alkyl esters of fatty acids and/or 2-ethylhexanol (also called iso-octanol);

(ii) from 10 to 40% w/w of one or more fatty alkanolamides; and (iii) up to about 10% w/w of one or more fatty acids.

EXAMPLES

The invention will now be further explained and illustrated by reference to the following non-limiting examples.

Components

The following components are used in the formulations in the examples below.

| | |
|---|---|
| 2-ethylhexanol | Ex Orica, Australia |
| Butyl canolate | Ex Victorian Chemical Company, Australia |
| Ethanol | Anhydrous ethanol ex CSR, Australia |
| Ethyl tallowate | Ex Victorian Chemical Company, Australia |
| Isooctyl oleate | Ex Clariant, Australia |
| Kerosene | Kerosene blue ex Recochem, USA |
| Methyl canolate | Ex Victorian Chemical Company, Australia |
| Methyl cocoate | Ex Victorian Chemical Company, Australia |
| Methyl soyate | Ex BF Goodrich, USA or P&G, USA |
| Oleic acid | Ex Dragon Chemicals, Australia |
| P878 mineral oil | Ex Shell Oil, Australia |
| USA Diesel | Winter grade ex Exxon, USA |
| Vicamid 825 | Oleyl diethanolamide ex Victorian Chemical Company, Australia |
| Vicamid 528 | Coco diethanolamide ex Victorian Chemical Company, Australia |

Example 1

A coupling agent according to the second aspect of the invention was prepared as follows:

| Component | Amount (% w/w) |
|---|---|
| 2-ethylhexanol | 80 |
| Vicamid 825 | 17 |
| Oleic acid | 3 |

The 2% v/v coupling agent was combined with 90% v/v diesel fuel and 8% v/v ethanol to provide a fuel blend according to the first aspect of the invention. This fuel blend was tested in two Landcruiser 4WD utility vehicles and one light diesel truck and the engines ran satisfactorily.

Example 2

A blend of ethanol and coupling agent was prepared according to the fourth aspect of the invention as follows:

| Component | Amount (% w/w) |
|---|---|
| Ethanol | 63.7 |
| Methyl soyate | 27.5 |
| Vicamid 825 | 8.0 |
| Oleic acid | 0.8 |

10% v/v of the ethanol blend was combined with 90% v/v diesel fuel to provide a fuel blend according to the third aspect of the invention. Similarly, 15% v/v of the ethanol blend was combined with 85% v/v diesel fuel to provide a fuel blend which satisfactorily ran the diesel (4 cylinder 1.5 liter) engine of a Volkswagen "Golf".

Example 3

Fuel blends according to the third aspect of the invention were prepared and tested for water stability.

| Component | 3A (ml) | 3B (ml) |
|---|---|---|
| Kerosene | 150 | 150 |
| P878 mineral oil | 150 | 150 |
| USA Diesel | 400 | 500 |
| Methyl Soyate | 180 | 100 |
| Ethanol | 100 | 80 |
| Vicamid 825 | 18 g | 18 g |
| Oleic acid | 2 g | 2 g |
| **Water stability testing** | **Formulation 1** | **Formulation 2** |
| Overnight in freezer @ −8° C. | clear uniform | clear uniform |
| 0.5 g water added, 2 hours in freezer at −8° C. | clear uniform | clear uniform |
| Further 0.5 g water added, 2 hours in freezer at −8° C. | clear uniform | 2 layers, cloudy |
| Cloud point of wet product* | <−8° C. | +5° C. |
| Final water content** (%) | 0.19 | 0.19 |

*The appearance of the cloud point shows the temperature at which instability of the formulation occurs. The lower the temperature of the cloud point evidences greater stability. The cloud point has no relevance to engine performance.

**Water content in the formulations, as here and later mentioned through the patent, has been measured via the Karl Fischer titration method (D4377 of the ASTM).

These results show that by the addition of the additives the water tolerance of the formulation has been improved.

Example 4

A series of formulations of 20% v/v anhydrous alcohol in USA 'winter grade' diesel oil were prepared and water stability compared.

| Formulation | Control | 4A | 4B | 4C |
|---|---|---|---|---|
| diesel | 80 | 65 | 65 | 65 |
| ethanol | 20 | 20 | 20 | 20 |
| 2-ethylhexanol | — | 9 | — | — |
| methyl cocoate | — | — | 9 | — |
| methyl soyate | — | — | — | 9 |
| Vicamid 825 | — | 5.5 | 5.5 | 5.5 |
| Oleic acid | — | 0.5 | 0.5 | 0.5 |

| Water stability | Control | 4A | 4B | 4C |
|---|---|---|---|---|
| Initial water (%) | 0.11 | 0.09 | 0.10 | 0.10 |
| Initial cloud point (CP) (° C.) | +12 | <−8 | <−8 | <−8 |
| +0.1% water, CP | n/a | <−8 | <−8 | <−8 |
| Further +0.1% water, CP | n/a | <−8 | <−8 | −6 |
| Further +0.1% water, CP | n/a | <−8 | <−8 | −3 |
| Further +0.1% water, CP | n/a | <−8 | −5 | +2 |
| Further +0.1% water, CP | n/a | <−8 | 0 | n/a |
| Further +0.1% water, CP | n/a | <−8 | +6 | n/a |
| Further +1.0% water, CP | n/a | <−8 | n/a | n/a |
| Further +0.2% water, CP | n/a | −4 | n/a | n/a |
| Further +0.1% water, CP | n/a | +2 | n/a | n/a |
| Final water (%) | 0.11 | 2.11 | 0.81 | 0.58 |

These results further show that by the addition of the additives the water tolerance of the formulation has been improved. Indeed formulation 4A is sufficiently robust that those skilled in the art will recognise that rectified ethanol can be used.

Example 5

A series of formulations of 10% v/v anhydrous alcohol in USA 'winter grade' diesel oil were prepared and water stability compared.

| Formulation | Control | 5A | 5B | 5C | 5D |
|---|---|---|---|---|---|
| Diesel | 90 | 80 | 80 | 80 | 80 |
| Ethanol | 10 | 10 | 10 | 10 | 10 |
| 2-ethylhexanol | — | 6 | — | — | — |
| Methyl soyate | — | — | 6 | — | — |
| Butyl canolate | — | — | — | 6 | — |
| Ethyl tallowate | — | — | — | — | 6 |
| Vicamid 825 | — | 3.6 | 3.6 | 3.6 | 3.6 |
| Oleic acid | — | 0.4 | 0.4 | 0.4 | 0.4 |

| Water stability | Control | 5A | 5B | 5C | 5D |
|---|---|---|---|---|---|
| Initial water (%) | 0.07 | 0.07 | 0.07 | 0.07 | 0.07 |
| Initial cloud point (CP) (° C.) | +2 | <−8 | <−8 | <−8 | <−8 |
| +0.1% water, CP | n/a | <−8 | <−8 | <−8 | <−8 |
| Further +0.1% water, CP | n/a | <−8 | +7 | +11 | +7 |

-continued

| Water stability | Control | 5A | 5B | 5C | 5D |
|---|---|---|---|---|---|
| Further +0.1% water, CP | n/a | <−8 | n/a | n/a | n/a |
| Further +0.1% water, CP | n/a | <−8 | n/a | n/a | n/a |
| Further +0.3% water, CP | n/a | <−8 | n/a | n/a | n/a |
| Further +0.1% water, CP | n/a | +4 | n/a | n/a | n/a |
| Final water (%) | 0.07 | 1.01 | 0.30 | 0.30 | 0.29 |

These results further show that by the addition of the additives the water tolerance of the formulation has been improved. Indeed formulation 5A is sufficiently robust that those skilled in the art will recognise that rectified ethanol can be used.

Example 6

A series of formulations of 5% v/v anhydrous alcohol in USA 'winter grade' diesel oil were prepared and water stability compared.

| Formulation | Control | 6A | 6B | 6C | 6D |
|---|---|---|---|---|---|
| Diesel | 95 | 90 | 90 | 90 | 90 |
| Ethanol | 5 | 5 | 5 | 5 | 5 |
| 2-ethylhexanol | — | 3 | — | — | — |
| Isooctyl oleate | — | — | 3 | — | — |
| Methyl soyate | — | — | — | 3 | — |
| Butyl canolate | — | — | — | — | 3 |
| Vicamid 825 | — | 1.8 | 1.8 | 1.8 | 1.8 |
| Oleic acid | — | 0.2 | 0.2 | 0.2 | 0.2 |

| Water stability | Control | 6A | 6B | 6C | 6D |
|---|---|---|---|---|---|
| Initial water (%) | 0.04 | 0.04 | 0.04 | 0.04 | 0.04 |
| Initial cloud point (CP) (° C.) | <−8 | <−8 | <−8 | <−8 | <−8 |
| +0.1% water, CP | +37 | <−8 | +33 | +25 | +26 |
| Further +0.1% water, CP | n/a | <−8 | n/a | n/a | n/a |
| Further +0.1% water, CP | n/a | −6 | n/a | n/a | n/a |
| Further +0.1% water, CP | n/a | +28 | n/a | n/a | n/a |
| Final water (%) | 0.16 | 0.39 | 0.16 | 0.16 | 0.16 |

These results further show that by the addition of the additives the water tolerance of the formulation has been improved.

Example 7

A series of formulations of 10% v/v anhydrous alcohol in USA 'winter grade' diesel oil were prepared using coco diethanolamide and water stability compared.

| Formulation | Control | 7A | 7B | 7C |
|---|---|---|---|---|
| Diesel | 90 | 80 | 80 | 80 |
| Ethanol | 10 | 10 | 10 | 10 |
| Methyl soyate | — | 6 | 6 | 6 |
| Vicamid 528 | — | 3.6 | 3.3 | 3.0 |
| Oleic acid | — | 0.4 | 0.7 | 1.0 |

| Water stability | Control | 7A | 7B | 7C |
|---|---|---|---|---|
| Initial water (%) | 0.07 | 0.05 | 0.06 | 0.06 |
| Initial cloud point (CP) (° C.) | +2 | −5 | <−8 | <−8 |
| +0.1% water, CP | n/a | +11 | −1 | <−8 |
| Further +0.1% water, CP | n/a | n/a | n/a | +16 |
| Further +0.1% water, CP | n/a | n/a | n/a | n/a |
| Final water (%) | 0.07 | 0.17 | 0.17 | 0.39 |

These results further show that by the addition of the additives the water tolerance of the formulation has been improved.

Example 8

A formulation of 10% v/v anhydrous alcohol in USA 'winter grade' diesel oil was prepared using methyl canolate and water stability compared.

| Formulation | Control | 8A |
|---|---|---|
| Diesel | 90 | 80 |
| Ethanol | 10 | 10 |
| Methyl canolate | — | 6 |
| Vicamid 825 | — | 3.6 |
| Oleic acid | — | 0.4 |

| Water stability | Control | 8A |
|---|---|---|
| Initial water (%) | 0.07 | 0.06 |
| Initial cloud point (CP) (° C.) | +2 | <−8 |
| +0.1% water, CP | n/a | <−8 |
| Further +0.1% water, CP | n/a | +11 |
| Further +0.1% water, CP | n/a | n/a |
| Final water (%) | 0.07 | 0.37 |

These results further show that by the addition of the additives the water tolerance of the formulation has been improved.

Example 9

A formulation of 15% v/v anhydrous alcohol in USA 'winter grade' diesel oil was prepared using a blend of additives and water stability compared.

| Formulation | Control | 9A |
|---|---|---|
| Diesel | 85 | 72 |
| Ethanol | 15 | 15 |
| 2-Ethylhexanol | — | 4 |
| Methyl soyate | — | 4 |
| Vicamid 825 | — | 4.5 |
| Oleic acid | — | 0.5 |

| Water stability | Control | 9A |
|---|---|---|
| Initial water (%) | 0.09 | 0.08 |
| Initial cloud point (CP) (° C.) | +6 | <−8 |
| +0.1% water, CP | n/a | <−8 |

-continued

| Water stability | Control | 9A |
|---|---|---|
| Further +0.1% water, CP | n/a | <−8 |
| Further +0.1% water, CP | n/a | <−8 |
| Further +0.1% water, CP | n/a | <−8 |
| Further +0.3% water, CP | n/a | −5 |
| Further +0.1% water, CP | n/a | +6 |
| Final water (%) | 0.09 | 1.01 |

These results further show that the water tolerance of the formulation has been improved. Indeed formulation 9A is sufficiently robust that those skilled in the art will recognise that rectified ethanol can be used.

The word 'comprising' and forms of the word 'comprising' as used in this description do not limit the invention claimed to exclude any variants or additions.

Modifications and improvements to the invention will be readily apparent to those skilled in the art. Such modifications and improvements are intended to be within the scope of this invention.

The claims defining the invention are as follows:

1. A diesel fuel blend comprising one or more diesel fuels, ethanol, and a coupling agent, wherein the amounts of the one or more diesel fuels, ethanol and coupling agent in the blend are:

(a) greater than about 65% of the one or more diesel fuels;

(b) up to about 20% v/v of the ethanol; and (c) up to about 15% v/v of the coupling agent;

wherein ethanol and the coupling agent are present in the blend, and the coupling agent comprises:

(i) greater than about 60% w/w 2-ethylhexanol;

(ii) from 10 to 40% w/w of one or more fatty alkanolamides; and (iii) up to about 10% w/w of one or more fatty acids;

wherein one or more fatty acids are present in the coupling agent.

2. A diesel fuel blend according to claim 1 wherein the one or more alkanolamides are derived from ethanolamine, diethanolamine, diglycolamine, isopropanolamine and diisopropanolamine.

3. A diesel fuel blend according to claim 1 wherein the one or more alkanolamides are derived from C8 to C20 saturated or unsaturated fatty acids of natural or synthetic origin.

4. A diesel fuel blend according to claim 1 wherein the alkanolamide is oleyl diethanolamide.

5. A diesel fuel blend according to claim 1 wherein the one or more fatty acids are selected from the group consisting of C8 to C20 saturated or unsaturated fatty acids of natural or synthetic origin.

6. A diesel fuel blend according to claim 1 wherein the fatty acid is oleic acid.

7. A coupling agent for use in fuel blends comprising diesel fuel and ethanol, the coupling agent comprising:

(a) greater than about 60% w/w 2-ethylhexanol;

(b) from 10 to 40% w/w of one or more fatty alkanolamides; and (c) up to about 10% w/w of one or more fatty acids;

wherein one or more fatty acids are Present in the coupling agent.

8. A diesel fuel blend comprising one or more diesel fuels, ethanol, and a coupling agent, wherein the amounts of the one or more diesel fuels, ethanol and coupling agent in the blend are:

(a) greater than about 65% v/v of the one or more diesel fuels;

(b) up to about 20% v/v of the ethanol; and (c) up to about 15% of the coupling agent;

wherein ethanol and the coupling agent are present in the blend, and the coupling agent comprises:

(i) greater than about 60% w/w of one or more alkyl esters of fatty acids;

(ii) from 10 to 40% w/w of one or more fatty alkanolamides; and (iii) up to about 10% w/w of one or more fatty acids;

wherein one or more fatty acids are present in the coupling agent.

9. A diesel fuel blend according to claim 8 wherein the one or more alkyl esters of fatty acids are derived from C8 to C20 saturated or unsaturated fatty acids of natural or synthetic origin.

10. A diesel fuel blend according to claim 8 wherein the one or more alkyl esters of fatty acids are derived from C1 to C8 alcohols.

11. A diesel fuel blend according to claim 8 wherein the one or more alkanolamides are derived from ethanolamine, diethanolamine, diglycolamine, isopropanolamine and diisopropanolamine.

12. A diesel fuel blend according to claim 8 wherein the one or more alkanolamides are derived from C8 to C20 saturated or unsaturated fatty acids of natural or synthetic origin.

13. A diesel fuel blend according to claim 8 wherein the alkanolamide is oleyl diethanolamide.

14. A diesel fuel blend according to claim 8 wherein the one or more fatty acids are selected from the group consisting of C8 to C20 saturated or unsaturated fatty acids of natural or synthetic origin.

15. A diesel fuel blend according to claim 8 wherein the fatty acid is oleic acid.

16. A coupling agent for use in fuel blends comprising diesel fuel and ethanol, the coupling agent comprising:

(a) greater than about 60% w/w of one or more alkyl esters of fatty acids;

(b) from 10 to 40% w/w of one or more fatty alkanolamides; and (c) up to about 10% w/w of one or more fatty acids;

wherein one or more fatty acids are present in the coupling agent.

17. A diesel fuel blend comprising one or more diesel fuels, ethanol, and a coupling agent, wherein the amounts of the one or more diesel fuels, ethanol and coupling agent in the blend are:

(a) greater than about 65% v/v of the one or more diesel fuels;

(b) up to about 20% v/v of the ethanol; and (c) up to about 15% of the coupling agent;

wherein ethanol and the coupling agent are present in the blend, and the coupling agent comprises:

(i) greater than about 60% w/w of one or more alkyl esters of fatty acids, 2-ethylhexanol, or a combination of one or more of said alkyl esters of fatty acids and 2-ethylhexanol;

(ii) from 10 to 40% w/w of one or more fatty alkanolamides; and (iii) up to about 10% w/w of one or more fatty acids;

wherein one or more fatty acids are present in the coupling agent.

* * * * *